United States Patent [19]

Waterbury

[11] 4,077,538

[45] Mar. 7, 1978

[54] VENDABLE RECLOSABLE BEVERAGE CONTAINER

[76] Inventor: Nelson J. Waterbury, Marschall Str 9, 8 Munich 40, Germany

[21] Appl. No.: 723,708

[22] Filed: Sep. 16, 1976

Related U.S. Application Data

[63] Continuation-in-part of Ser. No. 714,484, Aug. 16, 1976, abandoned.

[51] Int. Cl.[2] ..... B65D 41/32

[52] U.S. Cl. ..... 220/268; 220/269; 220/331

[58] Field of Search ..... 220/268, 269, 270, 307, 220/331, 336, 359, 254, 22

[56] References Cited

U.S. PATENT DOCUMENTS

| | | | |
|---|---|---|---|
| 2,731,836 | 5/1973 | Silver | 220/269 |
| 3,813,000 | 5/1974 | Underwood | 220/269 |
| 3,952,911 | 4/1976 | Bozek | 220/331 |

*Primary Examiner*—Ro E. Hart

*Attorney, Agent, or Firm*—Brumbaugh, Graves, Donohue & Raymond

[57] ABSTRACT

A rigid container having an opening in a rigid lid thereof, a pivotally mounted cap recessed beneath the upper end of the container and rotatable into position over said opening in the lid, and a seal on the lid and cap to provide an easy-to-open sealed closure which cannot be removed from the lid or dropped into the container.

32 Claims, 12 Drawing Figures

VENDABLE RECLOSABLE BEVERAGE CONTAINER

This application is a continuation-in-part of my copending application, Ser. No. 714,484, filed Aug. 16, 1976, now abandoned.

The invention relates to containers, for example, sealed containers of the type used to vend beverages and foods and more particularly to a rigid container having an opening in a lid thereof, a pivotally mounted cap recessed beneath the upper end of the container and pivotable into position over the opening, and a seal on the lid and cap to provide an easy-to-open closure which can be reclosed. The cap cannot be removed from the lid or dropped into the container.

Containers having upstanding pouring spouts or necks sealed by caps threaded onto the necks or spouts have long been in widespread use. Containers of this type have limitations, inter alia, in that the tops and bottoms thereof are not of uniform shape and size and cannot be stacked. The more recent "flip-top" tab closures overcome this disadvantage of necked or spouted containers, but they have other disadvantages, such as sharp edges which can cut the skin, a difficult to lift ring that can damage fingernails and the danger that the closure tab will be dropped into the container and accidentally swallowed.

The container of the present invention overcomes these disadvantages and provides a vendable airtight container which can be stacked, easily opened without injury to the user and then resealed to store the unused contents. The recessed cap makes is possible for the shape and size of the top and bottom of the container to be made uniform so that the containers can be stacked, packaged and handled in the manner of conventional metal cans. In the preferred form of the container, the cap can be easily pivoted on the lid away from the opening to dispense the contents from the container. After pivoting the cap away from the opening, it remains on the lid and cannot be lost or dropped back into the container through the opening. Thus there is no debris apart from the container and there is no danger that the cap will be swallowed accidentally by the user. Moreover, the cap can be easily pivoted back around the lid to reclose the opening for the storage of the unused container contents.

In accordance with the present invention, a cap pivoted on the lid seals an opening in the container. In one embodiment, the outer side of the cap and chime of the container function to insure the integrity of the seal. After pivoting the cap from the opening, and breaking a seal to dispense liquid, the container may be resealed by pivoting the cap to its sealing position. A pair of pivoted caps can also be provided on the lid to seal a pair of openings in a container including a partition to carry two different liquids.

For a complete understanding of the present invention, reference can be made to the detailed description which follows and to the accompanying drawings, in which FIG. 1 is a perspective view of the upper portion of a container embodying the present invention;

Figure 1:
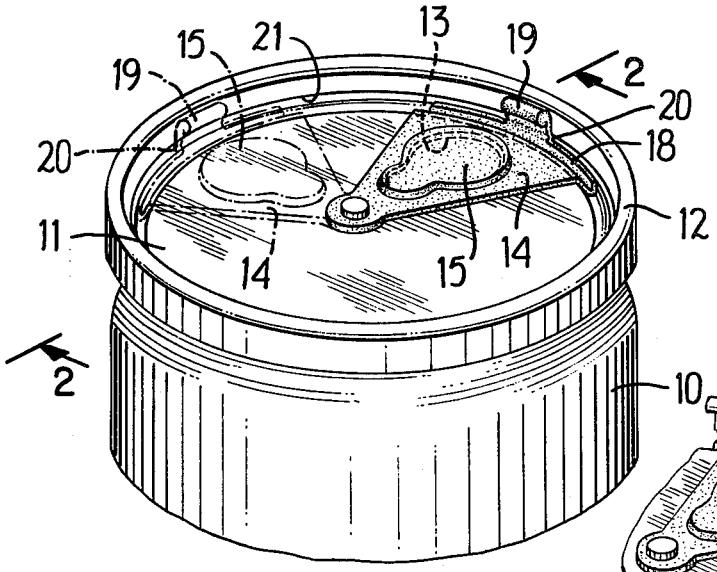
FIG. 1A is a partial view of the container of FIG. 1 showing a modified cap handle.
Figure 2:
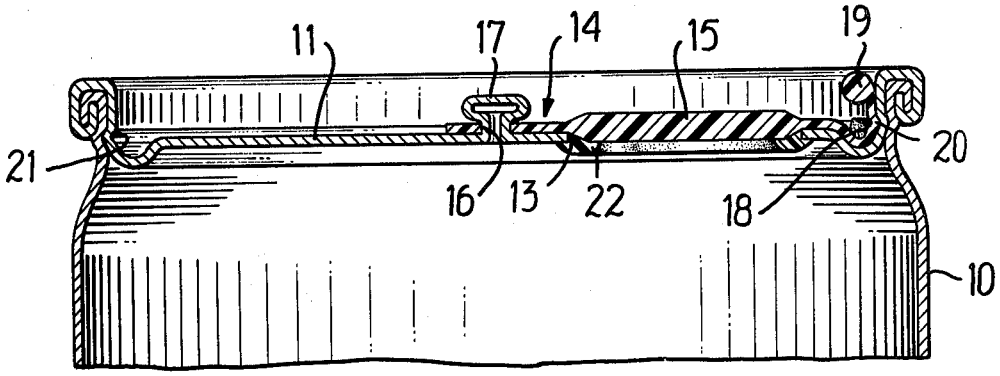
FIG. 2 is a cross-sectional view of the upper end of the container taken along the lines 2—2 of FIG. 1 looking in the direction of the arrows.
Figure 3:
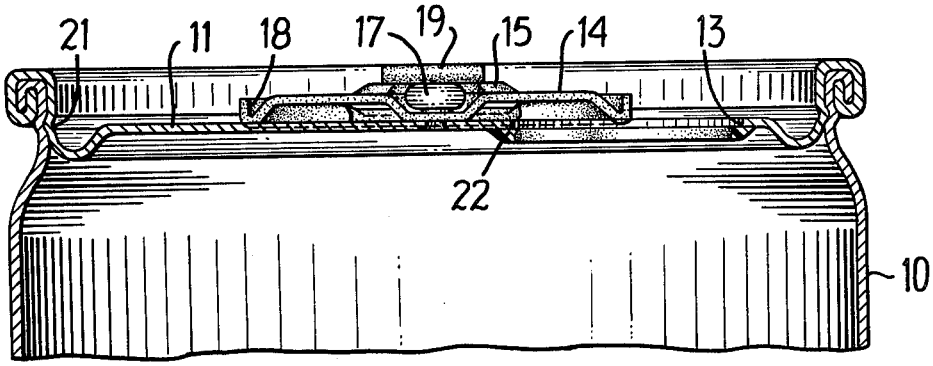
FIG. 3 is a cross-sectional view similar to FIG. 2 but with the cap pivoted 90° as shown in FIG. 1.
Figure 4:
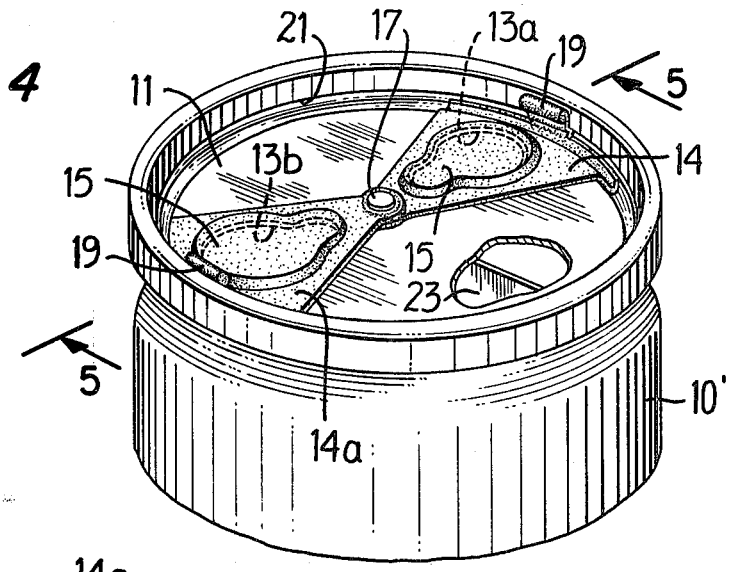
FIG. 4 is a perspective view of the upper portion of a container showing another embodiment of the present invention.

The container of the present invention, as shown in the embodiment illustrated in FIG. 1 through 3 of the drawings, includes a cylindrical side wall 10, an upper lid 11 joined to the upper end of the side wall by a chime 12 and a bottom (not shown) of the same shape and diameter as the upper end to permit the containers to be stacked.

The lid 11 is recessed beneath the upper edge of the chime 12 and contains an opening 13 offset from the center of the lid. The keyhole shape of the opening, as shown, facilitates pouring of liquids. The opening in the lid is closed by a generally triangularly shaped cap 14 formed with a thickened keyhole shaped portion 15 extending above and below the plane of the cap 14. The upwardly extending portion 15 is adapted to be engaged by the finger to facilitate rotation of the cap 14.

The inner apex end of the cap 14 includes an opening 16 through which extends a pivot 17 which can be formed as shown integrally with the lid 11. Of course the pivot 17 can be integral with the cap and then affixed to the lid 11 if desired.

The outer side of the cap 14 is formed into a U-shaped portion 18 following the contours of the lid and chime and having a radius matched to that of the chime. A handle 19 extends upwardly from the U-shaped portion 8 to provide for additional finger engagement for pivoting the cap on the lid 11. A protrusion such as an arcuate ridge 20 extends outwardly from the handle 19 and under a cooperating circumferential recess 21 in the chime to hold the cap 14 in proper sealing position on the lid 11.

The downwardly projecting portion of the thickened section 15 of the cap has the same configuration as and is slightly smaller than the keyhole-shaped opening 13, and fits therein, as shown in FIG. 2. To provide an effective seal, the underside of the lid and cap is covered or sprayed with a thin, non-toxic resinous layer or liner 22 of the type sometimes utilized in flip-top tab closures used in conventional cans. The portion of the thin seal which coincides with the opening will adhere to and remain with the cap as it is pivoted from the opening.

To insure the integrity of the container when subjected to internal pressures on the order of 90 pounds per square inch, or when subjected to atmospheric pressure with the contents of the container under vacuum, the enlarged cap portion 15 and the seal 22 are formed of suitable plastic materials with appropriate resilience to perform their function. Other suitable materials such as metal can also be used.

When the container is to be opened, the user pivots the cap 14 on the pivot 17 by finger pressure on the enlarged portion 15 and handle 19. This breaks the seal around the opening 13, and when the cap is positioned as shown in phantom outline in FIG. 1, the container contents can be poured out. The cap, however, remains on the container. If less than the entire container contents are used, the cap 14 is pivoted back to its original position and is held in sealed relation with the opening 13 by the protrusion 20 and recess 21.

Figure 1A:
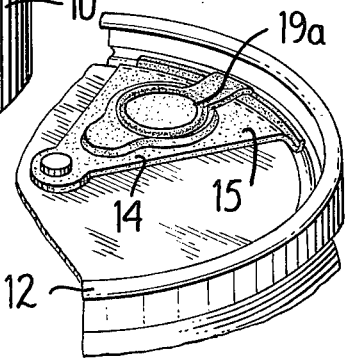

The handle 19 may also be enlarged, or comprise a ring 119*a*, as shown in FIG. 1A, to enable the user to flex the cap away from the lid to break the seal 22. The cap is then pivoted on the post 17 away from the opening. To reseal the container, the ridge 20 can be snapped into the recess 21 with the cap in its original position on the lid.

If it is unnecessary to have an effective seal when the container is reclosed, the ridge 20 and recess 21 may be omitted.

As shown in FIGS. 4 through 7, it is sometimes desirable to provide a container 10' with an interior partition 23 for holding two different liquids, for example gin and tonic. To empty the liquids, two openings 13*a* and 13*b*, preferably on opposite sides of the container as shown, are provided in the lid 11. The opening 13*a* is closed by a pivoted cap 14 constructed in the same fashion as the cap 14 in FIG. 1. The opening 13*a* also is sealed by a thin, non-toxic resinous layer or liner 22 as described in connection with FIGS. 1 through 3.

Figure 5:
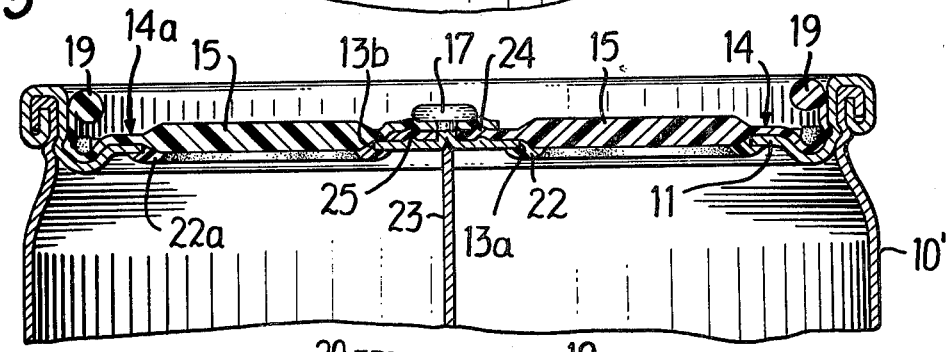
FIG. 5 is a cross-sectional view of the upper end of the container taken along the line 5—5 of FIG. 4 looking in the direction of the arrows.

Another cap 14*a*, similar to the cap 14 and pivoted on the pivot 17, closes the opening 13*b*. A seal 22*a* is applied in the same manner as the seal 22 and functions for the same purpose. To facilitate rotation of the caps 22 and 22*a*, cooperating circular ridges and recesses 24 and 25 are provided in the two caps concentric with the pivot, as shown in FIG. 5.

Figure 6:
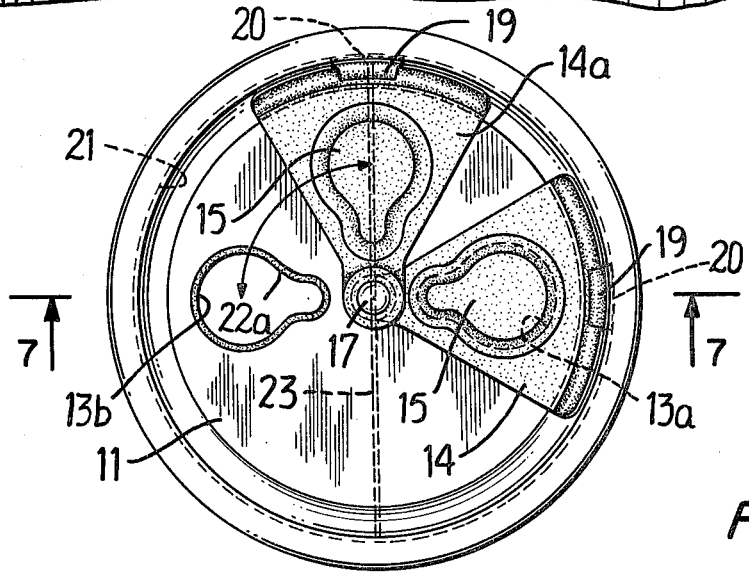
FIG. 6 is a plan view of the container of FIG. 4 showing one of the caps pivoted 90°.
Figure 7:
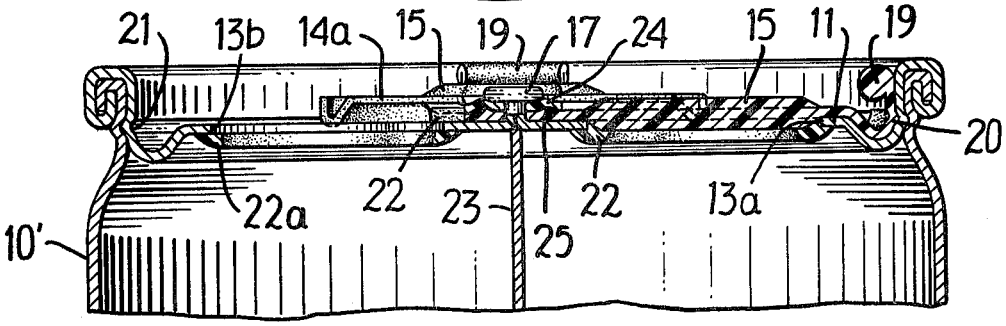
FIG. 7 is a cross-sectional view of the upper end of the container taken along the line 7—7 of FIG. 6 looking in the direction of the arrows.

In use, if it is desired to empty the contents of one section of the container 10', the cap 14*a* is pivoted in a clockwise direction by finger pressure on the portions 15 and 19 to unseal the opening 13, as shown in FIGS. 6 and 7. If the contents of the other section of the container are also required, the cap 14 is pivoted by finger pressure to unseal the opening 13*a*. It is apparent that with this arrangement, the contents of the container 10' can be poured separately or simultaneously. The caps 14 and 14*a* can also be pivoted to their original position to reseal the container 10'.

While the caps 14 and 14*a* have been shown as formed of plastic, any suitable material such as metal may also be used. The cap or caps may be positioned on the lid during the lid-forming operation or, if desired, a pivot may be incorporated into the caps and such pivot affixed to the lid at a suitable time. Also, a seal or stamp can be affixed across the pivoted cap or caps and container which will be broken when the cap is opened to show that the contents have not been consumed or contaminated.

Figure 8:
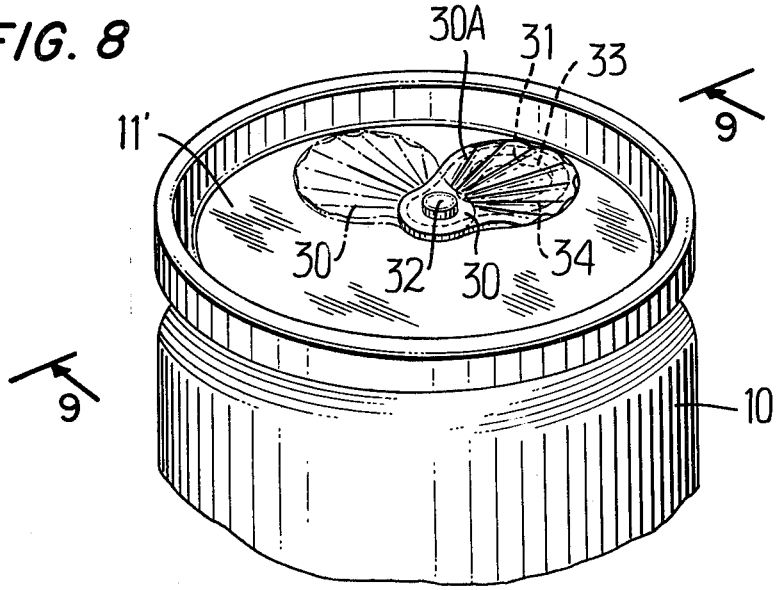
FIG. 8 is a perspective view of the upper portion of a container embodying another form of the invention.
Figure 9:
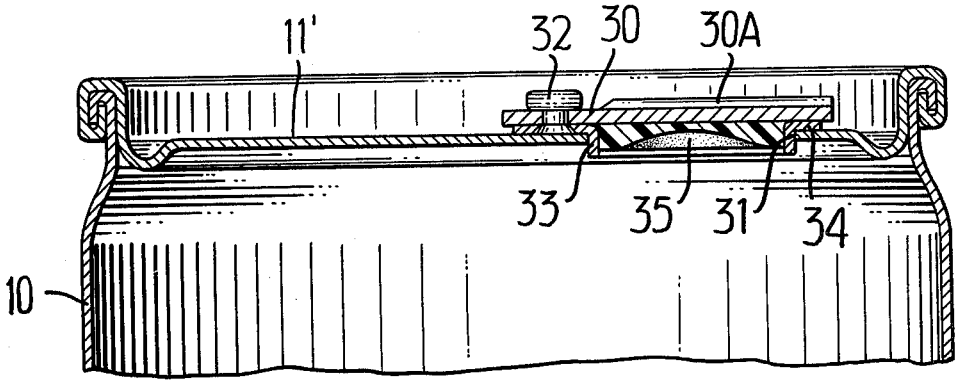
FIG. 9 is a cross-sectional view of the upper end of the container along the line 9—9 of FIG. 8 looking in the direction of the arrows.
Figure 10:
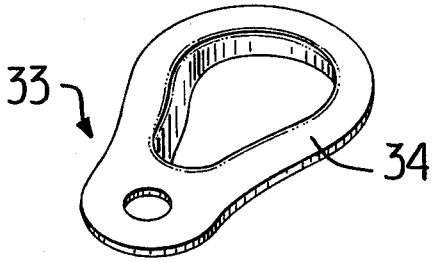
FIG. 10 is a perspective view of a discrete insert used in the container of FIG. 8.

FIGS. 8 through 10 show another embodiment of a container in which a cap or tab 30 closes an opening 31 in a lid 11' of the container 10. The cap 30 is pivoted on the lid 11' by a rivet 32, or other suitable pivot, to facilitate swinging the cap relative to the opening 31.

To facilitate using the invention with conventional type cans having conventional thin metal lids, a discrete insert 33 (FIG. 9) is suitably secured and sealed in the keyhole shaped opening 31 in the lid 11'. As shown in FIGS. 9 and 10, the insert 33 is formed with an upper lip or flange 34 circumferentially extending around the opening 31. The insert can be welded, brazed or otherwise suitably fastened to the lid to provide an effective seal between the lid and the insert. The insert 33 is formed to facilitate its insertion into lids of conventional type containers without altering the thickness of the lid.

When the pivoted cap or tab 30 is in the position over the opening 31, as shown in FIG. 8, it sealably engages the keyhole shaped flange 34. To provide a more effective seal, the insert and cap are covered or sprayed with a thin, non-toxic resinous and frangible layer or binder 35 of the type sometimes utilized in flip-top tab closures used in conventional cans. The portion of the thin seal, which coincides with the opening, will adhere to and remain on the underside of the cap after it is moved across the lid. With this arrangement, the integrity of the container will be assured with internal pressures on the order of 90 pounds per square inch, or when subjected to atmospheric pressure with the contents of the container under vaccum.

When the container is to be opened, the user pivots the cap or tab 30 by finger pressure on the ridges 30A to break the seal 35 between the insert 33 and the cap 30. The cap, however, remains on the container. If less than the container contents are used, the cap 30 is pivoted to its original sealed position, thereby reclosing the container.

Figure 11:
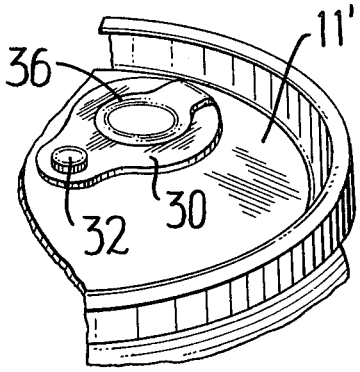
FIG. 11 is a partial view of the container of FIG. 8 showing a modified cap.

The modified cap shown in FIG. 11 includes a handle 36 on the cap portion adjacent the chime. To open the container, the handle 36 is grasped and pulled to flex the cap 30 away from the lid. This action breaks the frangible seal. The cap may then be pivoted away from the opening. If less than the container contents are used, the cap 30 is pivoted to its original sealed position, thereby reclosing the container. The cap 30 is made of a suitable metal or plastic to permit the user to flex it by pulling on the handle 36.

The invention has been shown and described in preferred forms and by way of example only, and different variations and modifications can be made therein within the spirit of the invention. The invention, therefore, is not intended to be limited in form or embodiment except insofar as such limitations are expressly set forth in the claims.

I claim:

1. A container comprising means including a chime and lid forming the upper end of a substantially rigid container, the lid being recessed below the upper end of the container, at least one opening in the lid for discharge of the contents of the container, a cap extending from the chime to the center of of the lid for closing the opening, the outer portion of the cap engaging the chime, means on the cap and chime to hold the cap in its sealing position on the lid, means pivoting the cap at a pivot point at the center of the lid, sealing means on the lid around the opening and on the cap to form an airtight seal, and finger engageable means on the cap for pivoting it on the lid for unsealing the opening.

2. A container as set forth in claim 1 in which the finger engageable means extends from the portion of the cap adjacent the chime to facilitate flexing the cap upwardly to release the cap from the chime and to break the sealing means.

3. A container as set forth in claim 2 in which the holding means includes a protrusion on one of the cap and chime and a recess on the other of the cap and chime, the protrusion and recess cooperating to hold the cap in its sealing position on the lid.

4. A container as set forth in claim 1 in which the sealing means includes a frangible sealing layer on the lid extending to the cap.

5. A container as set forth in claim 4 in which the frangible sealing layer is sprayed on the lid and cap.

6. A container as set forth in claim 4 in which the frangible sealing layer is in the form of a tape.

7. A container as set forth in claim 4 in which a finger engageable handle extends from the portion of the cap adjacent the chime to facilitate flexing the cap upwardly to break the sealing means.

8. A container as set forth in claim 4 in which the handle comprises a ring.

9. A container as set forth in claim 1 in which the sealing means can withstand pressures on the order of 90 pounds per square inch.

10. A container as set forth in claim 1 in which the cap, pivoting means and finger engageable means are below the upper end of the container.

11. A container as set forth in claim 1 in which the pivoted means includes a pivot formed in the lid and an opening formed in the cap.

12. A container as set forth in claim 1 in which a thickened portion of the cap has the same configuration as the opening in the lid, the thickened portion being slightly smaller than the opening and extending into the opening to facilitate sealing and resealing of the container.

13. A container as set forth in claim 12 in which the thickened cap portion extends upwardly for use as a finger engageable portion.

14. A container as set forth in claim 1 in which a partition divides the container into two sections with the one opening communicating with one section, a second opening in the lid communicating with the second section, a second cap for closing the second opening, means pivoting the second cap at the pivot point, sealing means on the lid around the second opening and on the cap to form an airtight seal, and finger engageable means on the second cap for pivoting it on the lid for unsealing the second opening.

15. A container as set forth in claim 1 in which the finger engageable means includes a ring extending from the portion of the cap adjacent the chime to facilitate breaking of the seal.

16. A container as set forth in claim 1 including a seal across the closed cap and container and affixed to both so that the affixed seal will be broken when the container is opened.

17. A container comprising means forming the upper end of a substantially rigid container, a lid recessed below the upper end of the container, at least one opening in the lid for the discharge of the contents of the container, a pivoted cap for closing the opening, the cap extending from the chime toward the center of the lid, the outer portion of the cap engaging the chime, means on the cap and chime to hold the cap in engagement with the chime and in its sealing position on the lid, means pivoting and holding the cap on the lid, frangible sealing means on the lid around the opening and on the cap to form an airtight seal, the cap when positioned in overlying relationship to the opening functioning to close the opening with the sealing means tightly sealing the opening, and a finger engageable portion on the cap for pivoting it on the lid for unsealing the opening.

18. A container as set forth in claim 17 in which the sealing means includes a sealing layer on the lid extending to the cap to seal the opening.

19. A container as set forth in claim 18 in which the sealing layer is sprayed on the lid and cap.

20. A container as set forth in claim 18 in which the sealing layer is in the form of a tape.

21. A container as set forth in claim 17 in which the seal can withstand pressures on the order of 90 pounds per square inch.

22. A container as set forth in claim 17 in which a finger engageable handle extends from the portion of the cap adjacent the chime to facilitate flexing the cap upwardly to break the sealing means.

23. A container as set forth in claim 17 in which the cap, pivoting means and finger engageable means are below the upper end of the container.

24. A container comprising means forming the upper end of a substantially rigid container, a lid recessed below the upper end of the container, at least one opening in the lid for the discharge of the contents of the container, a discrete insert sealed into the opening in the lid, a pivoted cap for closing the opening, the cap extending from a point adjacent the chime toward the center of the lid, means pivoting and holding the cap on the lid, frangible sealing means on the insert and on the cap to form an airtight seal, the cap when positioned in overlying relationship to the opening functioning to close the opening with the sealing means tightly sealing the opening, and a finger engageable portion on the cap for pivoting it on the lid for unsealing the opening.

25. A container as set forth in claim 24 in which the insert includes a flange surrounding the opening on the upper side of the lid and engaging the cap and the selaing means includes a sealing layer on the insert extending to the cap to seal the opening.

26. A container as set forth in claim 25 in which the sealing layer is sprayed on the insert and cap.

27. A container as set forth in claim 25 in which the sealing layer is in the form of a tape.

28. A container as set forth in claim 24 in which the seal can withstand pressures on the order of 90 pounds per square inch.

29. A container as set forth in claim 24 in which a finger engageable handle extends from the portion of the cap adjacent the chime to facilitate flexing the cap upwardly to break the sealing means.

30. A container as set forth in claim 24 in which the cap, pivoting means and finger engageable means are below the upper end of the container.

31. A container as set forth in claim 24 in which the pivoting means includes a pivot formed in the insert.

32. A container comprising means forming the upper end of a substantially rigid container, a lid recessed below the upper end of the container, at least two openings in the lid for the discharge of the contents of the container, a partition dividing the container into separate sections with one opening communicating with one section and the other opening communicating with the other section, a pair of pivoted caps, one closing one opening and the other closing the other opening, means pivoting and holding the caps on the lid, frangible sealing means on the lid around both openings and the respective caps to form airtight seals, and finger engageable means on each cap for pivoting it on the lid for unsealing the respective opening.

* * * * *